United States Patent [19]

Nowacki

[11] 4,160,406

[45] Jul. 10, 1979

[54] METHOD AND APPARATUS FOR ERECTING A CARTON

[75] Inventor: Ulrich G. Nowacki, Leisure City, Fla.

[73] Assignee: International Paper Company, New York, N.Y.

[21] Appl. No.: 917,483

[22] Filed: Jun. 21, 1978

[51] Int. Cl.[2] ..... B31B 1/06; B31B 1/26; B31B 1/62

[52] U.S. Cl. ..... 93/36.3; 93/49 M; 93/53 M; 93/53 SD

[58] Field of Search ..... 93/36 SQ, 36.3, 49 M, 93/49 R, 53 R, 53 M

[56] References Cited

U.S. PATENT DOCUMENTS

| | | | |
|---|---|---|---|
| 3,333,514 | 8/1967 | Jones | 93/36 SQ |
| 3,421,415 | 1/1969 | Pearsor | 93/36.3 |
| 3,828,659 | 8/1974 | Reichert | 93/49 M |
| 3,902,407 | 9/1975 | Trosdorff | 93/49 R |
| 3,948,151 | 4/1976 | Derderian | 93/36.3 |
| 3,952,636 | 4/1976 | Reichert | 93/53 SD |
| 3,967,434 | 7/1976 | Mancini | 93/53 R X |
| 3,987,710 | 10/1976 | Reichert | 93/36 SQ |
| 4,018,143 | 4/1977 | Dice | 93/36.3 |
| 4,041,850 | 8/1977 | Reichert | 93/53 M |
| 4,044,657 | 8/1977 | Reichert | 93/49 M |

*Primary Examiner*—Robert D. Baldwin

*Attorney, Agent, or Firm*—Donald E. Degling

[57] ABSTRACT

The present invention relates to a compact high speed carton erecting and sealing machine and method employing a horizontal blank feeding mechanism. Carton blanks are fed into the erecting station, positioned against a stop and vacuum erected from the trailing side panel. The erected blank is maintained in a squared position and driven through the machine by flights mounted on parallel chain conveyors adjustably positioned adjacent the long sides of the erected carton. As the erected carton is driven through the machine, the trailing and leading bottom end flaps are sequentially folded into place and then the bottom side flaps are partially folded into place. With the side flaps in a partially folded position, adhesive is applied to either or both the bottom end flaps and the bottom side flaps. The partially folded side flaps are then maintained in position by a fixed anvil as the carton is delivered by the conveyor to a set of squaring stops. A transversely moving platen then moves the carton laterally to clear the end stops while bringing the end and side flaps into sealing relationship under time and pressure conditions sufficient to effect adhesion between the side and end flaps. Thereafter, the erected and sealed carton is ejected from the machine by the movement of the succeeding carton into the sealing station.

15 Claims, 9 Drawing Figures

METHOD AND APPARATUS FOR ERECTING A CARTON

BACKGROUND OF THE INVENTION

1. Field of the Invention

The present invention relates to container fabrication equipment and more particularly to a method and apparatus for erecting paperboard containers from flat blanks therefore and sealing the bottom flaps thereof.

2. Prior Art

Paperboard cartons are commonly used by manufacturers to ship manufactured goods such as food products, machine parts and the like to distributors, retail outlets or ultimate consumers. Such paperboard cartons are frequently manufactured in the form of carton blanks which may be shipped flat for convenience and economy. Thus, it becomes necessary for the user of the carton to unfold or erect the blank and seal the bottom flaps prior to filling the carton with manufactured goods. A common form of carton comprises a single blank having four side panels joined together at opposite side edges of the panels and having four top panels and four bottom panels joined to respective opposite edges of the side panels. While such blanks may be erected and sealed manually by forming the blank into a rectangular tube, folding in the bottom end panels, applying adhesive and finally folding and sealing the lateral bottom panels, it is economically desirable to perform some or all of these operations automatically in a sealing machine or in an erecting and sealing machine.

A number of erecting and sealing machines are shown in the prior art, e.g. Jones U.S. Pat. No. 3,333,514; Pearson U.S. Pat. No. 3,421,415; Reichert U.S. Pat. No. 3,828,659; Trosdorff U.S. Pat. No. 3,902,407; Reichert U.S. Pat. No. 3,952,636; Reichert U.S. Pat. No. 3,987,710; Reichert U.S. Pat. No. 4,041,850; Reichert U.S. Pat. No. 4,044,657; Mancini U.S. Pat. No. 3,967,434; and Dice, Jr. U.S. Pat. No. 4,018,143. Derderian U.S. Pat. No. 3,948,151 is an example of a sealing machine alone.

Various complex mechanical devices have been employed to perform the required erecting, folding and sealing functions. Jones U.S. Pat. No. 3,333,514, for example, discloses a progressive operation in which the erection is accomplished by levers or star wheels in conjunction with transversely moving squaring fingers. Pearson U.S. Pat. No. 3,421,415 employs a special blank having interconnected flaps at one end and a pair of moving platens for sealing the bottom flaps. Reichert U.S. Pat. No. 3,828,659, also utilizing a blank with interconnected flaps on one end, delivers the blanks in a vertical position and folds the interconnected flaps against the sides to produce an erected box with the top flaps held in the fully opened position.

The following Reichert patents all relate to a single erecting and sealing machine: Reichert U.S. Pat. No. 3,952,632 discloses a dispensing apparatus for such a machine designed to drop blanks vertically into an erecting mechanism. Reichert U.S. Pat. No. 3,987,710 describes a box squaring device in conjunction with a vacuum erecting system. Reichert U.S. Pat. No. 4,041,850 describes a method of erecting cases including steps of positioning the blanks over a drop chute. Reichert U.S. Pat. No. 4,044,657 discloses a method and apparatus for sealing an erected carton using a pair of moving platens.

Mancini U.S. Pat. No. 3,967,434 discloses a carton erecting, filling and closing machine employing an intermittent motion sequence which stops at each station to perform the particular operation required.

Dice Jr. U.S. Pat. No. 4,018,143, like Mancini U.S. Pat. No. 3,967,434, employs an intermittent motion mechanism for a case erecting and sealing machine.

BRIEF SUMMARY OF THE INVENTION

The present invention relates to a compact high speed carton erecting and sealing machine and method employing a horizontal blank feeding mechanism. Carton blanks are fed into the erecting station, positioned, against a stop and vacuum erected from the trailing side panel. The erected blank is maintained in a squared position and driven through the machine by flights mounted on parallel chain conveyors adjustably positioned adjacent the long sides of the erected carton. As the erected carton is driven through the machine, the trailing and leading bottom end flaps are sequentially folded into place and then the bottom side flaps are partially folded into place. With the side flaps in a partially folded position, adhesive is applied to either or both the bottom end flaps and the bottom side flaps. The partially folded side flaps are then maintained in position by a fixed anvil as the carton is delivered by the conveyor to a set of squaring stops. A transversely moving platen then moves the carton laterally to clear the end stops while bringing the end and side flaps into sealing relationship under time and pressure conditions sufficient to effect adhesion between the side and end flaps. Thereafter, the erected and sealed carton is ejected from the machine by the movement of the succeeding carton into the sealing station.

The erecting and sealing machine according to the present invention is adjustable to accommodate a range of carton sizes having various lengths, widths and depths. The machine is operable at a range of speeds up to a maximum of about 40 cartons per minute.

DESCRIPTION OF THE PREFERRED EMBODIMENT

Figure 1:
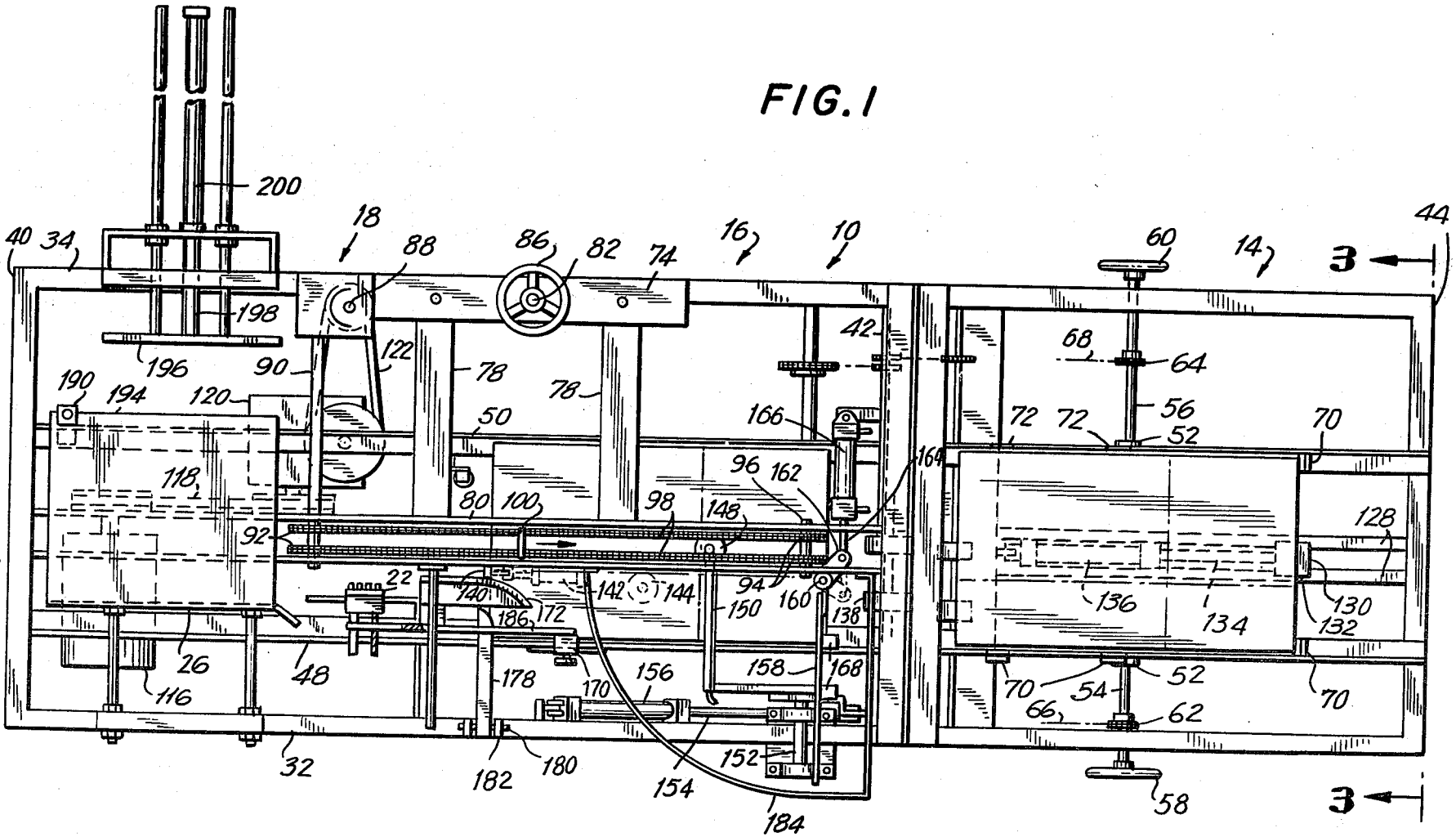
FIG. 1 is a top plan of the erecting and sealing machine according to the present invention wherein the blank feeding station is at the right, the erecting station is at the center and the sealing station is at the left, the blank being driven through the machine from right to left as shown in the Figure.
Figure 2:
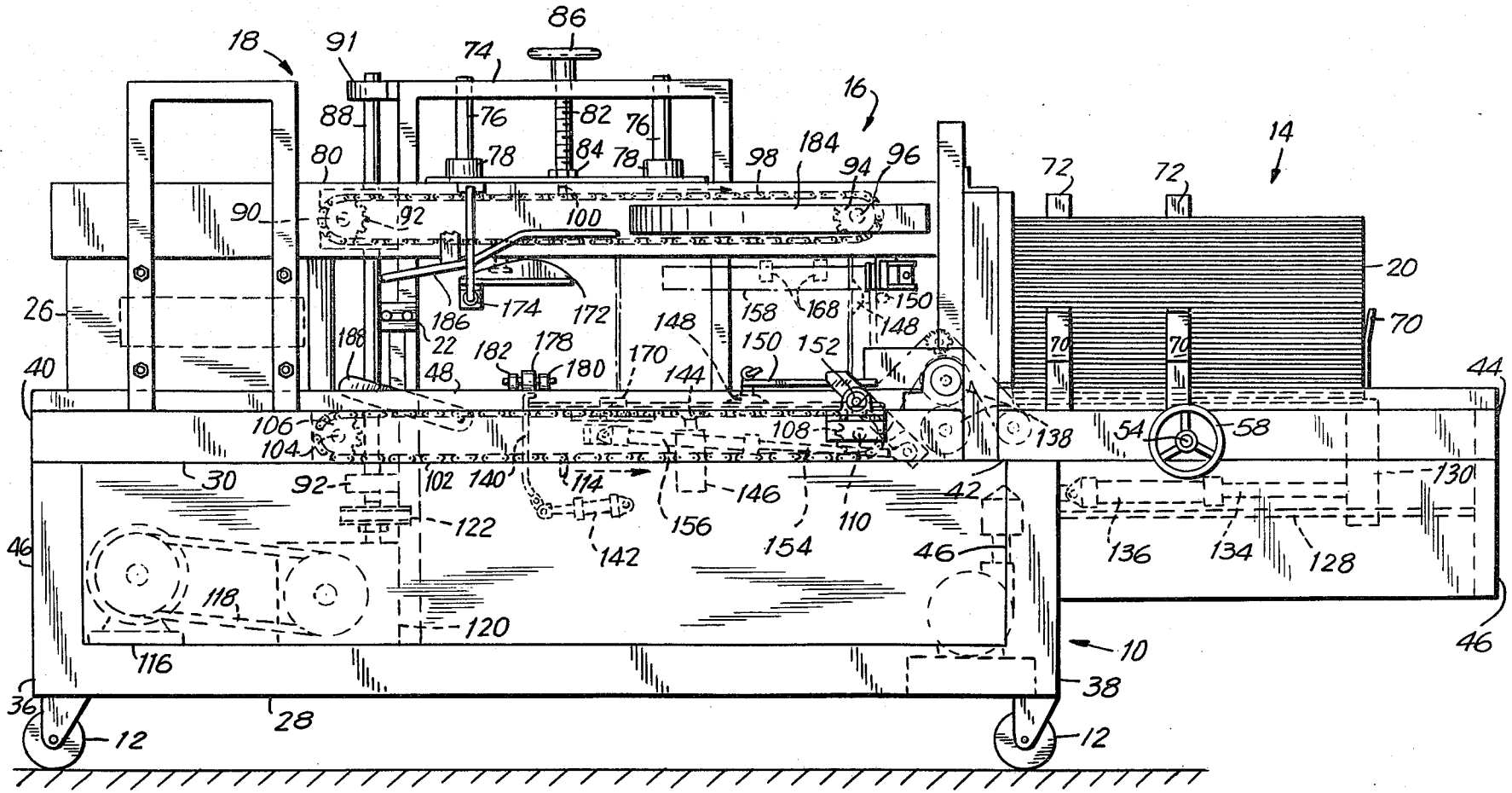
FIG. 2 is a front elevational view of the erecting and sealing machine shown in FIG. 1.
Figure 3:
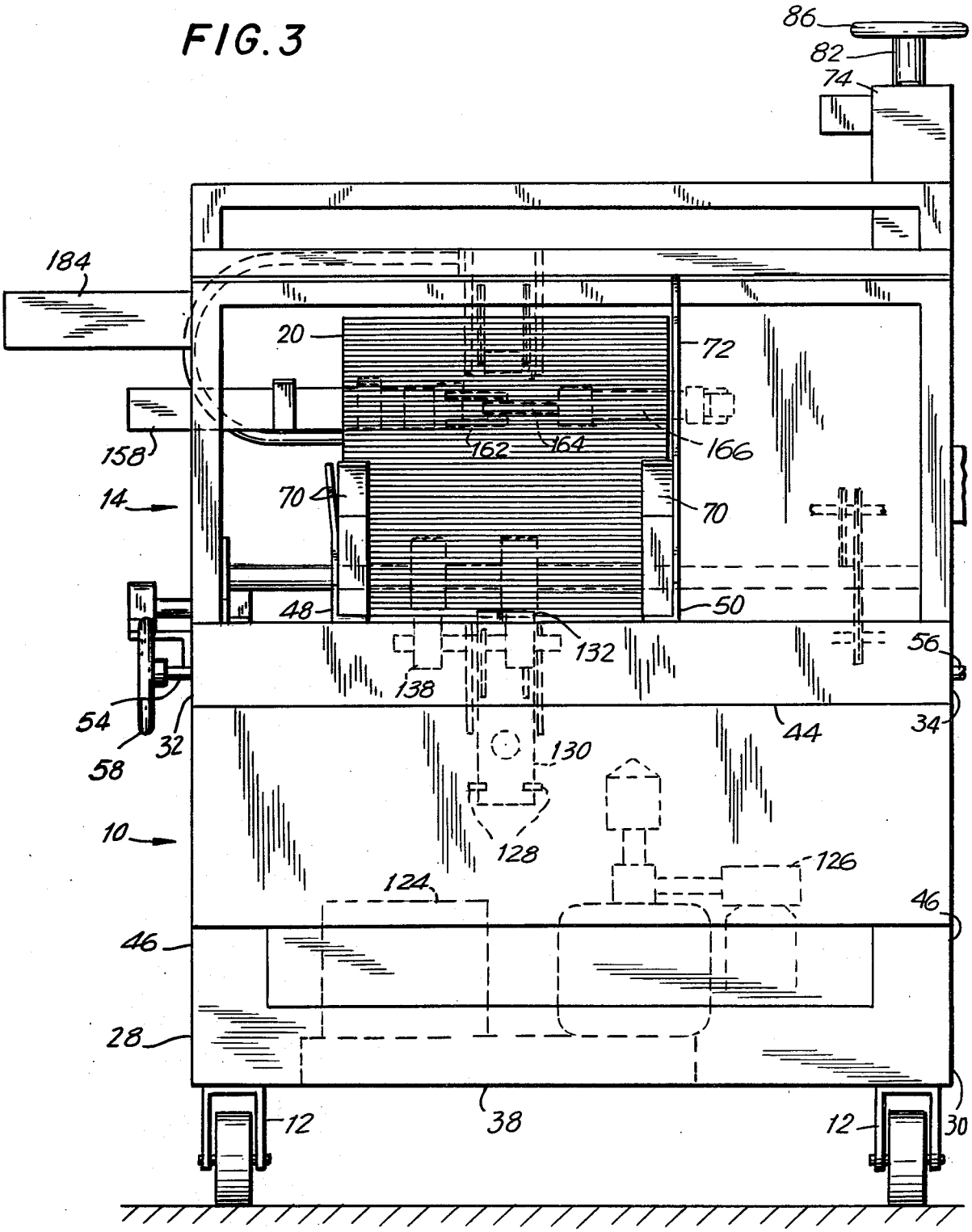
FIG. 3 is an end elevation on a somewhat larger scale taken along lines 3—3 of FIG. 1.
Figure 4:
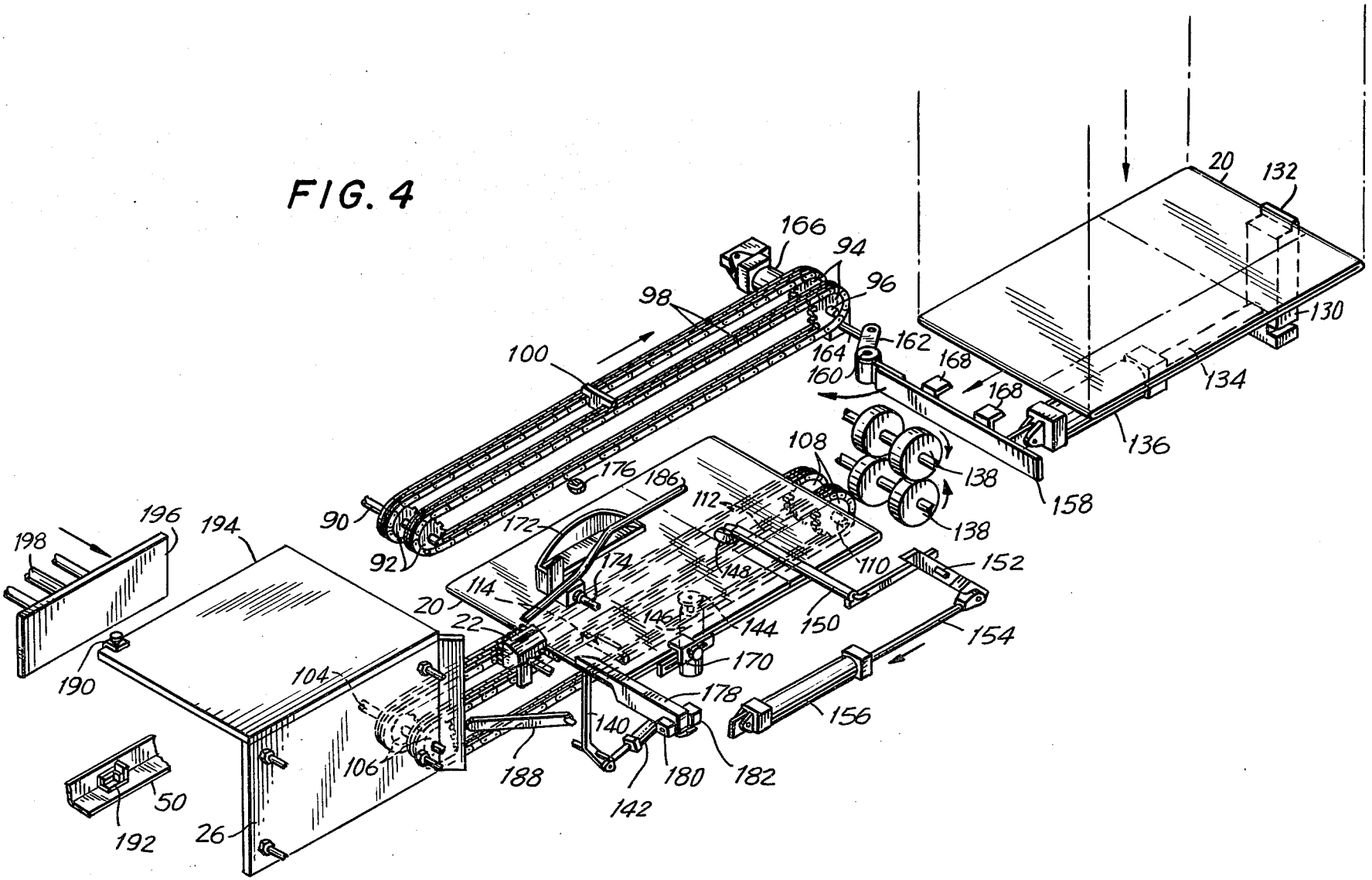
FIG. 4 is a fragmentary perspective view showing the principal elements of the blank feeding mechanism, the carton erecting mechanism, the squaring and folding mechanism, the glueing mechanism, the sealing mechanism, and the blank just prior to erection.

The erecting and sealing machine 10 according to the present invention is shown in top, front elevation and end views; respectively, in FIGS. 1–3. The machine 10 is compact and may be mounted on lockable caster wheels 12 for easy movement within a plant location. Broadly, the machine 10 comprises a blank feeding station 14, an erecting and folding station 16, and a sealing station 18.

A horizontally disposed stack of carton blanks 20 may be loaded into the blank feeding station 14 from which single blanks are delivered flat to the erecting station 16. During continuous passage through the erecting station 16, the carton blank 20 is first erected to form a rectangular tube having top and bottom flaps substantially co-planar with the side panel to which the respective top and bottom flaps are attached. Thereafter, in sequence, the trailing and leading bottom end flaps are folded and then the side flaps are partially folded. The now erected blank 20 passes a glue head 22 which sprays a hot melt adhesive onto a portion of the outer surface of the bottom end flaps or the inner surface of the side flaps or both as the erected blank 20 is driven from the erecting station 16 into the sealing station 18. After the erected blank 20 comes to rest within the sealing station 18 a moving platen 196 enters the erected blank 20 from the top and moves the erected blank 20 transversely into sealing relationship against a fixed anvil 26. The sealing relationship is maintained for a short period of time sufficient to adhere the bottom end flaps of the erected blank to the adjacent side flaps so as to form an erected and sealed carton. The completed carton is ejected from the machine by the movement of the following erected blank 20 into the sealing station 18 of the machine. While a carton blank 20 having both top and bottom flaps has been described, it will become apparent that a blank having no top flaps may also be erected and sealed by the process and apparatus of the present invention.

The functions of the process having been outlined, the structural elements of the machine 10 by which the process is performed will be described with reference to FIGS. 1–3. The details of the equipment by which the process steps are accomplished will then be described with reference to the sequential fragmentary views of FIGS. 4–9.

Referring now to FIGS. 1–3, the machine 10 comprises a generally rectangular frame having lower longitudinal frame members 28, 30 and upper longitudinal frame members 32, 34. The lower frame members 28, 30 are welded in spaced relation to lower transverse frame members 36, 38 while the upper frame members 32, 34 are welded in spaced relation to upper transverse frame members 40, 42, 44. The frame of the machine is completed by vertical columns 46 welded at each end to the upper and lower frame sections.

A pair of angle members 48, 50 is positioned longitudinally of the machine 10 on the transverse members 40, 42, 44 with the horizontal flanges juxtaposed in facing relationship to form a carton blank track. Each angle member 48, 50 is provided inwardly from each end with a nut 52 (only one of which is shown for each member 48, 50) into which are threaded screw members 54, 56. The screw members 54, 56 are journalled respectively into the upper longitudinal frame members 32, 34 and carry at their outer ends handwheels 58, 60. Sprocket wheels 62, 64 keyed respectively to the screw members 54, 56 carry chains 66, 68 which pass around similar sprocket wheels keyed to screw members (not shown) at the opposite end of the angle members 48, 50. It will be appreciated that rotation of the handwheels 58, 60 will cause the respective angle members 48, 50 to move transversely to the length of the machine 10 while maintaining a parallel relationship so as to accommodate a variety of carton blank sizes as may be required. In the blank feeding station, vertically disposed guide arms 70, 72 are welded to the angle members 48, 50 to properly position the carton blanks 20 in the blank feeding station 14. Preferably the guide arms 72 are longer than the guide arms 70 to facilitate the loading of carton blanks 20.

A superstructure 74 is welded to the upper longitudinal frame member 34 and carries vertically disposed tubular support bars 76. Cantilever members 78 are journalled at one end to slide on the tubular support bars 76 and on the opposite end to support an upper chain conveyor frame 80. A screw member 82 journalled in the superstructure 74 is threaded into a nut 84 fastened to the cantilever members 78 and carries a handwheel 86 at its upper end. It will be seen that rotation of the handwheel 86 will cause the cantilever members 78 and the upper chain conveyor frame 80 to move in a vertical direction but remain parallel to the angle members 48, 50 so as to accommodate a variety of carton widths.

A vertical spline shaft 88 is journalled for rotation in a bearings 91, 92 mounted on the superstructure 74. The spline shaft 88 is connected to upper conveyor drive shaft 90 by means of a pair of miter gears (not shown) one of which is provided with an internal spline to mate with the spline shaft 88 and slide along said spline shaft when the upper chain conveyor frame is adjusted in the vertical direction. The opposite end of drive shaft 90 is journalled for rotation in the upper chain conveyor frame 80 and carries a pair of sprocket wheels 92. A similar pair of sprocket wheels 94 is keyed to a stub shaft 96 journalled in the upper chain conveyor frame 80 adjacent the blank feeding station 14. A pair of chains 98 connect the sprocket wheels 92, 94 and carry a single transverse flight 100.

A lower chain conveyor frame 102 is mounted on upper transverse frame members 40 and 42 and is positioned below the angle members 48, 50. A drive shaft 104 journalled at one end in the lower chain conveyor frame 102 is connected on the opposite end to the spline shaft 88 by a pair of miter gears (not shown). A pair of sprocket wheels 106 is keyed to the drive shaft 104. A similar pair of sprocket wheels 108 is keyed to a stub shaft 110 journalled in the lower chain conveyor frame 102 adjacent the blank feeding station 14. A pair of chains 112 engage the sprocket wheels 106, 108 and carry a single transverse flight 114. Sprocket wheels 92, 94, 106 and 108 all have the same pitch diameter and, as will be appreciated, are driven by the spline shaft 88. Thus, the upper and lower conveyor chains 98 and 112 will move at the same linear speed and the flights 100 and 114 will remain directly opposite one another. The spline shaft 88 is driven by a motor 116 through a train comprising a variable speed belt drive 118, a geared speed reducer 120 and a belt 122.

For purposes which will be described hereafter, the erecting machine 10 is provided with a compressor 124 to produce a supply of air under pressure and a vacuum pump 126 to produce a source of negative pressure or suction.

Turning now to the blank feeding station 14, a pair of parallel longitudinal guides 128 are fastened to the machine frame below but parallel to the longitudinal angle members 48, 50 to define a guideway therebetween and to delimit the reciprocal movement of feed dog 130 which is formed with a lip 132 of sufficient height to engage the lowermost carton blank 20 in the blank feeding station 14. The feed dog 130 is pivotally connected to the piston 134 of a double acting air cylinder 136 which, in turn, is pivotally attached to the upper transverse frame member 42. It will be understood that by admission of air from the compressor 124 into the air cylinder 136 the feed dog 130 may be driven in a longitudinal and reciprocal direction along the guides 128 so as to feed a carton blank 20 into the erecting and folding station 16.

As the carton blank 20 enters the erecting and folding station 16 it is engaged by spaced pinch rolls 138 and driven against a pivoted stop 140 (FIG. 5) actuated by an air cylinder 142. The pivoted stop 140 is spaced from the pinch rolls 138 a distance grearer than the folded length of the carton blank 20 so that the blank is freed from the influence of the pinch rolls 138.

When the carton blank 20 comes to rest within the erecting and folding station 16, a vacuum or suction is applied to the lower side panel of the blank 20 by a suction cup 144 mounted on an air cylinder 146 which moves the suction cup 144 in a vertical direction so as to engage the lower side panel of the blank 20. The pivoted stop 140 is then moved out of the path of travel of the carton blank 20 by actuation of the air cylinder 142.

After the suction cup 144 has engaged the lower side panel of the carton blank 20, a second suction cup 148 engages the trailing side panel of the carton blank 20. Suction cup 148 is mounted on an L-shaped transverse arm 150 pivoted at 152 which, in turn, is connected to the piston 154 of a double acting air cylinder 156 pivotally mounted on the machine frame. The air cylinder 156 is then actuated so as to cause the arm 150 to swing on the pivot 152 and erect the carton blank 20 to form a rectangular tube with the top and bottom flaps co-planar with their respective side panels and the upper and lower side panels restrained respectively against the moving conveyor chains 98 and 112. Simultaneously, the suction cups 144 and 148 are deactivated and the flights 100 and 114 engage the top and bottom edges of the trailing side panel of the carton blank 20 and begin to drive the blank through the erecting and folding station 16.

Figure 5:
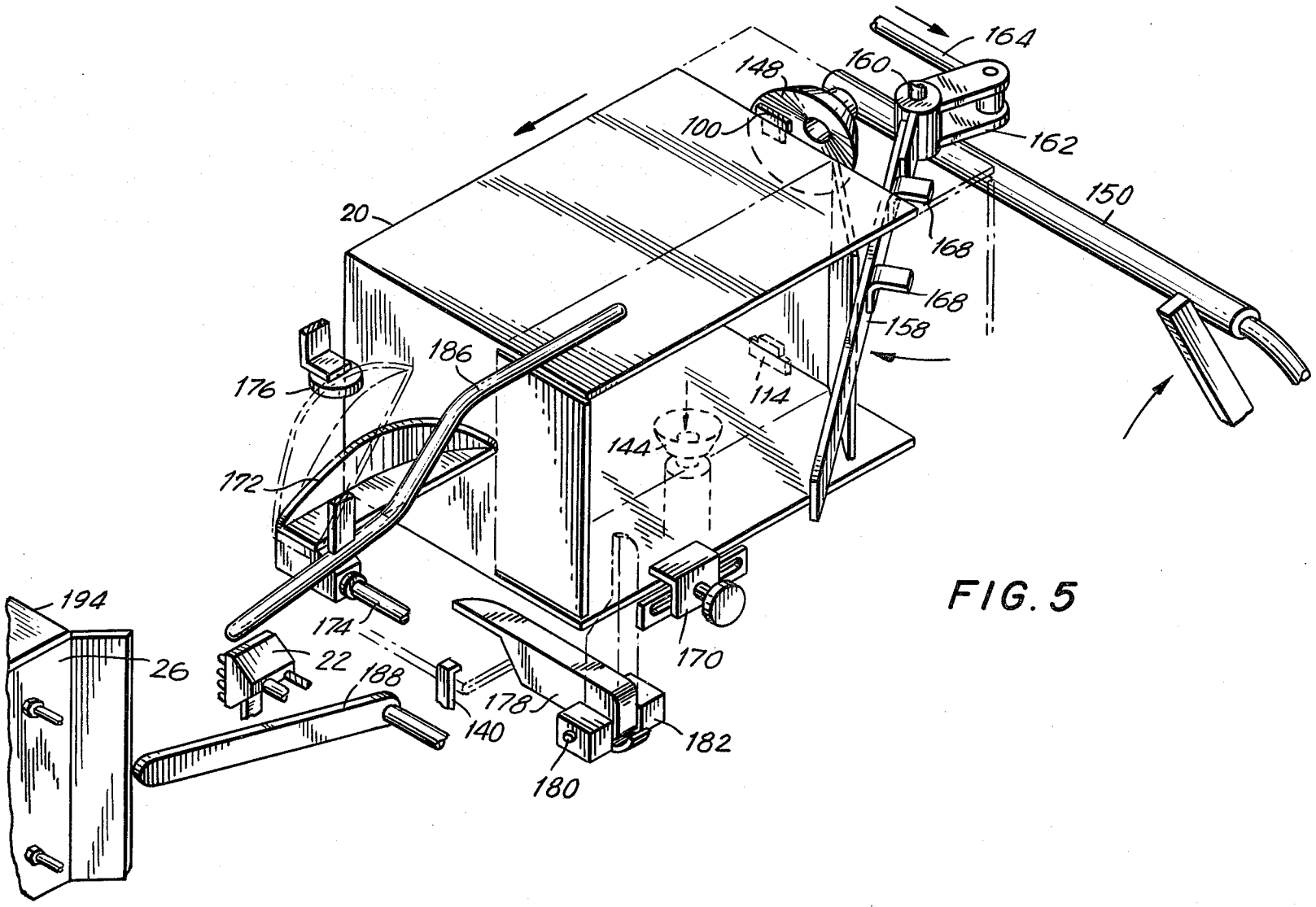
FIG. 5 is a fragmentary perspective view showing the carton in the fully erected position with the trailing bottom end flap in a partially folded position.

A trailing bottom end flap folding arm 158 pivoted on pin 160 to swing in a horizontal plane is driven by a lever arm 162 pivotally connected to the piston 164 of a double acting air cylinder 166 which is, in turn, pivotally connected to the machine frame. As the folding arm 158 swings horizontally, it engages the trailing bottom end flap and folds it through an arc of 90° to a position normal to the trailing side panel (FIG. 5). In order to facilitate the folding of the trailing and leading bottom end flaps it is desirable to insure that the top and bottom side flaps are maintained in a horizontal position during the folding of the end flaps. The horizontal position of the upper side flap is maintained by angles 168 fastened to the arm 158 while the lower side flap is held in horizontal position by an adjustable lip 170 mounted on the machine frame.

Figure 6:
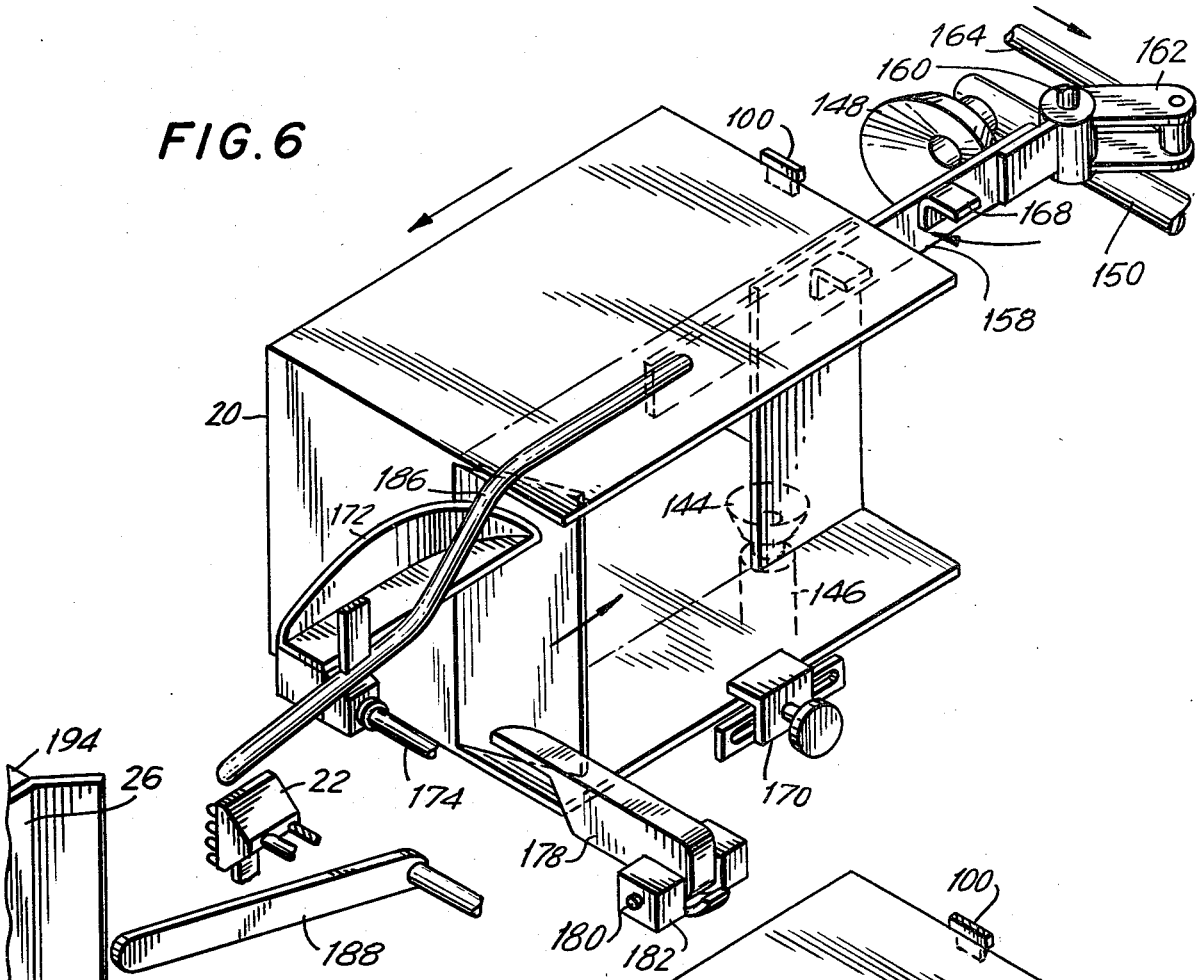
FIG. 6 is a fragmentary perspective view showing the carton in the fully erected position, the trailing bottom end flap in the fully folded position and the leading bottom end flap in a partially folded position.
Figure 7:
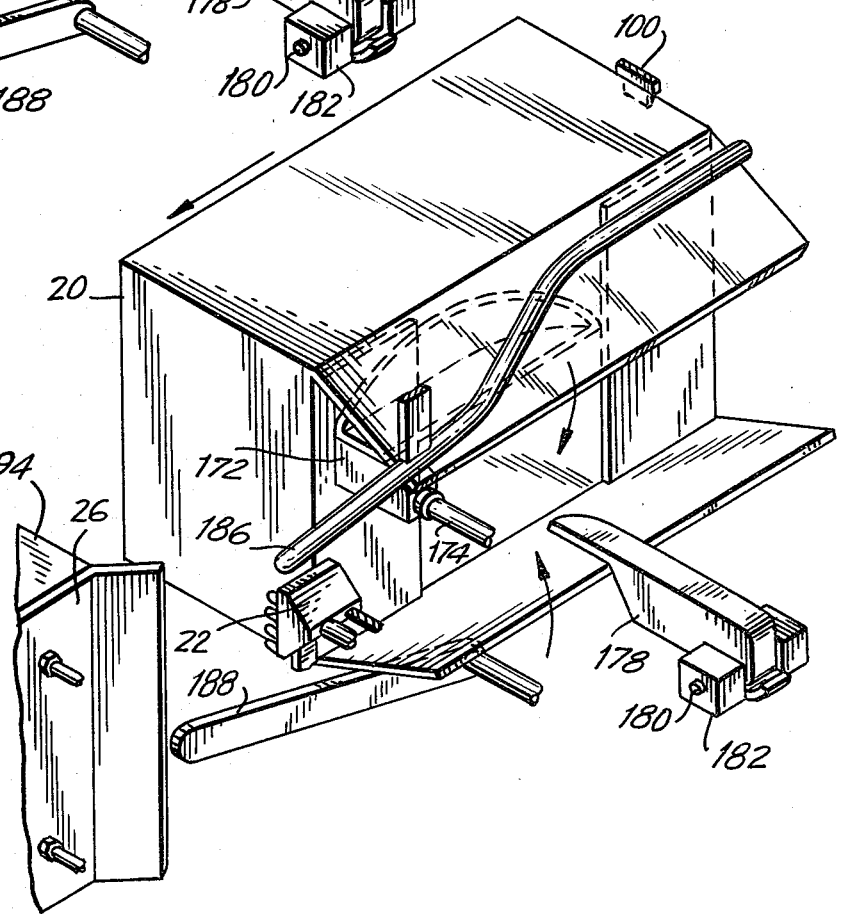
FIG. 7 is a fragmentary perspective view showing the carton in the fully erected position, the bottom end flaps in the fully folded position and the bottom side flaps in a partially folded position.

As the erected blank 20 moves through the erecting station 16, the leading end flap of the blank engages a shoe 172 mounted on a pivot pin 174. The shoe 172 is formed with a curved face which urges the leading bottom end flap into a folded position where it is normal to the side panel to which it is connected (FIGS. 5, 6 & 7). The shoe 172 is pivoted so as to allow the blank 20 to pass the shoe 172 during erection of relatively larger blanks (smaller blanks will normally clear the shoe 172 during erection). A stop 176 may be provided, if desired, to limit the upward travel of the shoe 172. In the event that relatively wide cartons, or cartons made from light material, are to be erected, it may be desirable to provide supplemental folding means in order to avoid creasing the leading flap. In this circumstance, an adjustable supplemental folding arm 178 pivoted on a pin 180 may be provided. The folding arm mounting block 182 is fastened to the machine frame. Before the leading bottom end flap reaches its fully folded position, the folding arm 158 is retracted to its initial position by the actuation of the air cylinder 166. A quadrant-shaped guard 184 mounted on the machine frame is provided to protect the operator from any possibility of injury which might result from contact with the folding arm 158.

Following the folding of the end flaps, the upper side flap of the erected carton blank 20 contacts a folding bar 186 which gradually urges the upper side flap toward a folded position. At about the same time, the lower side flap engages a folding arm 188 which similarly gradually urges the lower side flap toward a folded position (FIG. 7).

As shown in FIGS. 6 and 7 a glueing head 22 is positioned so as to lie between the fully folded end flaps and the partially folded side flaps of the erected carton blank 20 as the blank is driven past the location of the glueing head. The glueing head 22 may be a commercially available device such as a Nordson Model A having four nozzles, which is capable of spraying hot melt glue from a glue reservoir (not shown) in a predetermined pattern on one or both facing surfaces of the end flaps and side flaps.

Figure 8:
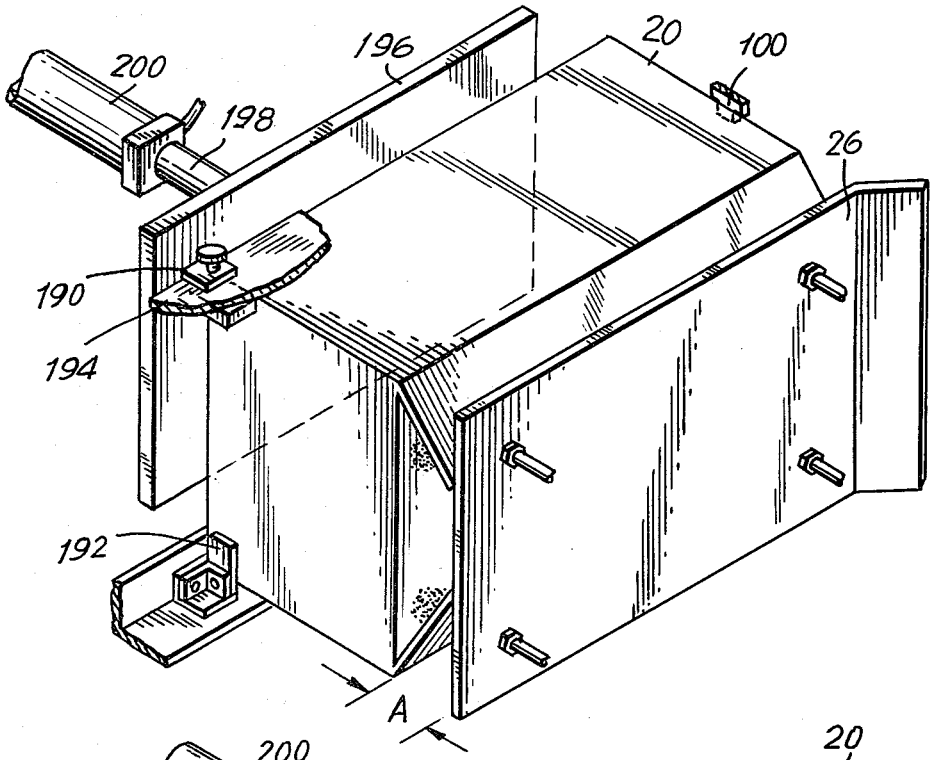
FIG. 8 is a fragmentary perspective view showing the carton against the squaring stops of the sealing station and having adhesive applied to the flaps.
Figure 9:
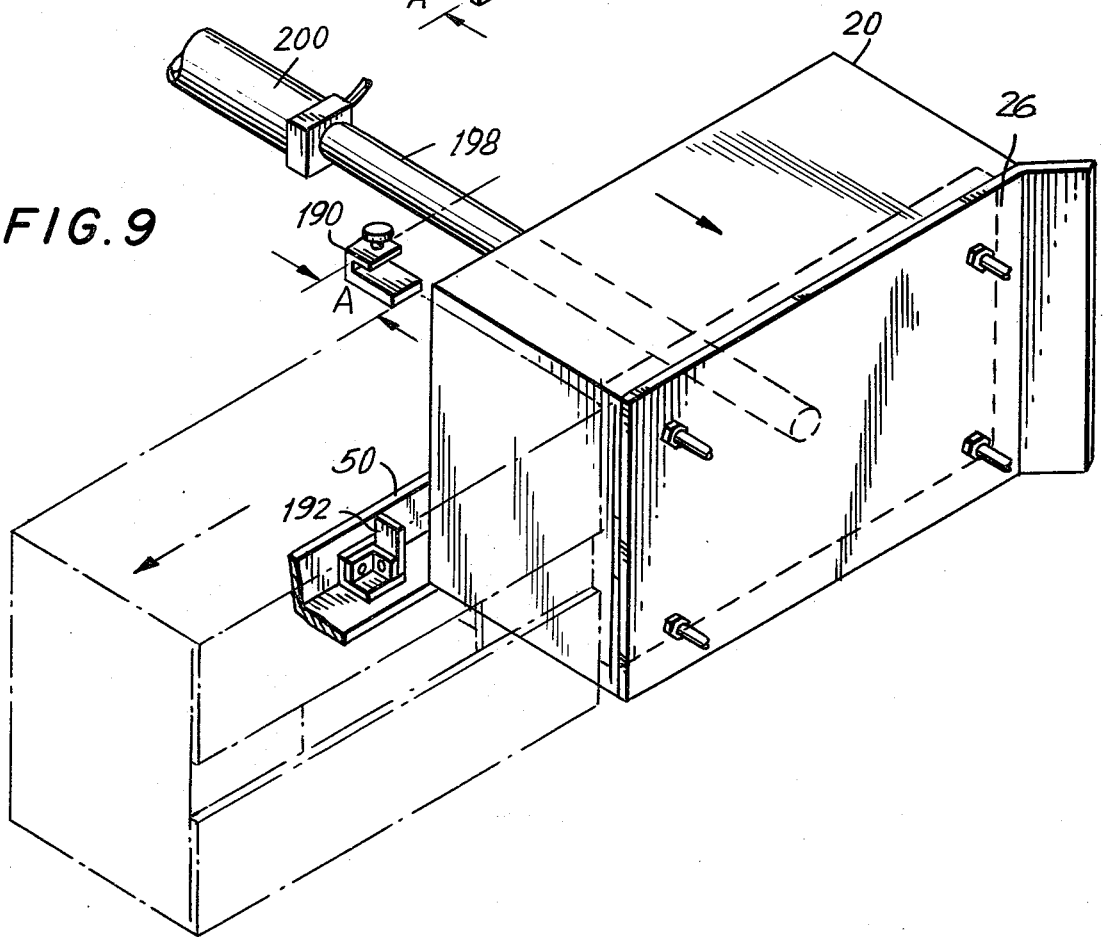
FIG. 9 is a fragmentary perspective view of the carton after it has been moved transversely so as to seal the bottom end and sides flaps and prior to ejection of the completed carton from the machine.

After passing the glueing head 22, the erected and partially folded carton blank 20 is driven by the conveyor chain flights 100 and 114 into the sealing station 18 where it comes to rest against upper and lower squaring stops 190, 192. The upper squaring stop 190 is adjustably mounted on a plate 194 fastened to the fixed anvil 26 (FIG. 8). The lower squaring stop 192 is adjustably fastened to the angle member 50. As soon as the erected and partially folded carton blank 20 comes to rest within the sealing station 18, a moving platen 196 connected to the piston 198 of a double acting air cylinder 200 begins to move transversely relative to the angle members 48, 50 so as to impel the moving platen 196 into the erected carton blank 20. When the moving platen 196 strikes the inner surfaces of the leading and trailing end flaps of the carton 20, it urges the carton blank 20 a distance "A" transversely until the blank contacts the fixed anvil 26 thereby bringing the end flaps and side flaps of the carton blank 20 into sealing relationship and causing the carton blank 20 to clear the squaring stops 190, 192 (FIGS. 8 and 9). The sealing relationship of the end flaps and side flaps is maintained for a time sufficient for the hot melt adhesive applied by the glue head 22 to set so as to firmly adhere the end and side flaps of the carton 20. Thereafter, the moving platen 196 is retracted by actuation of the air cylinder 200 so that the completed carton 20 may be ejected from the machine when the following carton blank 20 is driven into the sealing station 18 by the flights 100, 114 on the conveyor chains 98, 112.

It will be understood from the preceding description that the various functions of the apparatus must be performed in a timed sequence. It is conventional to provide, for example, a series of cam operated switches to provide timed control signals to actuate valves or switches in the several pneumatic and electrical systems to control the actuation of the various air cylinders, vacuum devices, conveyors and glue head. As such control systems and circuits are well known, it is deemed unnecessary to describe them in detail.

It will be appreciated that applicant has disclosed a compact high speed erecting and sealing machine and process capable of reliably and effectively erecting and sealing carton blanks to form completed cartons ready for use in the packing and shipping of various types of manufactured goods. Applicant's machine is characterized by a continuously operating double conveyor which receives a blank from a blank feeding station and, in the course of delivering it to a sealing station performs in sequence the necessary erecting, folding and adhesive applying functions. As the sealing process on one carton blank is performed while the succeeding blank is being erected and folded, and no recycling or empty return time is required, the machine cycle is highly efficient, resulting in a high machine output together with highly compact machine having a total length less than about 3½ times the maximum length of the folded blank which the machine can accommodate. An exemplary form of the machine is adapted to handle folded carton blanks having a folded length ranging from 18 to 36 inches (457 mm to 915 mm) and a folded width ranging from 10 to 29 inches (254 mm to 737 mm) to produce cartons having a length ranging from 10 to 26 inches (254 mm to 660 mm), a width ranging from 6 to 18 inches (152 mm to 457 mm) and a depth ranging from 4 to 18 inches (102 mm to 457 mm). Such a machine is capable of producing up to about 40 cartons per minute.

The terms and expressions which have been employed are used as terms of description and not of limitation and there is no intention, in the use of such terms and expressions, of excluding any equivalents of the features shown and described or portions thereof, but it is recognized that various modifications are possible within the scope of the invention claimed.

What is claimed is:

1. A process for erecting and sealing a folded carton blank comprising four side panels joined at opposite edges and having two bottom side flaps and two bottom end flaps each of which is joined respectively to one of said side panels, the steps comprising: positioning a plurality of said carton blanks in a blank feeding station of a carton erecting and sealing machine to form a vertical column with each of said carton blanks lying in a horizontal plane; feeding in timed sequence the lowermost carton blank from said vertical column of carton blanks into a pinch roll driving means; driving said carton blank longitudinally through said erecting and sealing machine into a carton erecting and folding station; erecting said carton blank by applying a turning moment to the trailing side panel of said carton blank while maintaining the lower side panel of said carton blank stationary in a horizontal plane; driving said erected carton blank longitudinally through said erecting and sealing machine, sequentially folding the trailing bottom end flap and then the leading bottom end flap to a plane normal to the plane of the side panel to which each of said trailing and leading bottom flaps is respectively connected, partially folding said upper and lower side flaps toward said folded trailing and leading bottom end flaps, applying adhesive material between the surfaces of said bottom end flaps facing said bottom side flaps, and bringing said erected and partially folded carton blank to rest against squaring stops in a sealing station in said erecting and sealing machine; driving said partially folded carton blank transversely clear of said squaring stops and against a fixed anvil in said sealing station whereby said bottom side flaps are folded in sealing relationship against said bottom end flaps; holding said bottom side flaps and said bottom end flaps in sealing relationship until said adhesive material has adhered said bottom end flaps to said bottom side flaps; and ejecting said completed erected and sealed carton from said erecting and sealing machine.

2. The process described in claim 1 in which the adhesive material is applied to the surfaces of the bottom end flaps facing the bottom side flaps.

3. The process described in claim 1 in which the adhesive material is applied to the surfaces of the bottom side flaps facing the bottom end flaps.

4. The process described in claim 1 in which the adhesive material is applied both to the surfaces of the bottom end flaps facing the bottom side flaps and to the surfaces of the bottom side flaps facing the bottom end flaps.

5. The process described in claim 1 in which the lower side panel of said carton blank is maintained in the carton erecting and folding station by vacuum means and the turning moment is applied to the trailing end panel of said carton blank by vacuum means.

6. The process described in claim 1 in which the completed erected and sealed carton is ejected from the erecting and sealing machine by the movement of a following carton blank into the sealing station of said erecting and sealing machine.

7. Apparatus for erecting and sealing carton blanks including a blank feeding station, a blank erecting and folding station and a sealing station comprising longitudinal track members arranged to guide a carton blank in a horizontal direction, vertical guide means defining said carton blank feeding station at one end of said longitudinal track to accommodate a stack of horizontally disposed carton blanks, reciprocating carton blank feed means communicating with the lowermost carton blank in the stack of carton blanks, pinch roll carton blank feeding means to drive a carton blank into said carton erecting and folding station against a movable stop, vacuum restraining means located below said longitudinal track members to engage a lower side panel of the carton blank, vacuum erecting means swingably engageable with an upper trailing side panel of said carton blank to erect the carton blank, a pair of horizontally disposed chain conveyors each having a transverse flight engageable with the trailing side panels of the erected carton blank, a horizontally swingable trailing bottom end flap folding means, a leading bottom end flap folding shoe, an upper bottom side flap folding bar, a lower bottom side flap folding arm, a glue head juxtaposed to pass between the bottom end flaps and the bottom side flaps of the erected carton blank during passage of the carton blank through said erecting and folding station, at least one adjustable end stop in said sealing station, fixed anvil means in said sealing station and transversely movable platen means in said sealing station movable within said erected carton blank to seal the bottom end flaps to the bottom side flaps of the erected carton blank against said fixed anvil.

8. An apparatus as described in claim 7 having a pair of adjustable end stops in said sealing station, one of which is fastened to one of said longitudinal track members and the other of which is fastened to said fixed anvil.

9. An apparatus as described in claim 7 wherein the horizontally swingable trailing bottom end flap folding means is provided with upper bottom flap supporting angles whereby the upper bottom flap of the carton blank is maintained in a horizontal aspect during folding of the trailing and leading bottom end flaps.

10. An apparatus as described in claim 7 in which an adjustable lip is mounted on one of the longitudinal track members in the erecting and folding station to maintain the lower bottom flap of the carton blank in a horizontal aspect during folding of the trailing and leading bottom and end flaps.

11. An apparatus as described in claim 7 in which an adjustable supplemental leading bottom end flap folding arm is located in the erecting and folding station.

12. An apparatus as described in claim 7 in which the leading bottom end flap folding shoe is pivotally mounted for oscillatory motion in a vertical plane and a stop is located in the path of travel of said pivotally mounted folding shoe to limit the vertical motion thereof.

13. An apparatus as described in claim 7 in which the longitudinal track means are adjustable in a transverse direction to accommodate carton blanks of varying blank width.

14. An apparatus as described in claim 7 in which the pair of horizontally disposed chain conveyors are adjustable in a vertical direction to accommodate erected carton blanks of varying carton width.

15. Apparatus for erecting and sealing carton blanks including a blank feeding station, a blank erecting and folding station and a sealing station comprising adjustable longitudinal track members arranged to guide a carton blank in a horizontal direction, vertical guide means defining said carton blank feeding station at one end of said longitudinal track to accommodate a stack of horizontally disposed carton blanks, reciprocating carton blank feed means communicating with the lowermost carton blank in the stack of carton blanks, pinch roll carton blank feeding means to drive a carton blank into said carton erecting and folding station against a movable stop, vacuum restraining means located below said longitudinal track members to engage a lower side panel of the carton blank, vacuum erecting means swingably engageable with an upper trailing side panel of said carton blank to erect said carton blank, a pair of vertically adjustable horizontally disposed chain conveyors, each having a transverse flight engageable with the trailing side panel of the erected carton blank, a horizontally swingable trailing bottom end flap folding means having upper bottom flap supporting angles, a leading bottom end flap folding shoe pivotally mounted for oscillatory motion in a vertical plane, a stop located in the path of travel of said pivotally mounted folding shoe, an adjustable supplemental leading bottom end flap folding arm located in said erecting and folding station, an adjustable lower bottom flap guiding lip mounted on one of said longitudinal track members in said erecting and folding station, an upper bottom side flap folding bar, a lower bottom side flap folding arm, a glue head juxtaposed to pass between the bottom end flaps and the bottom side flaps of the erected carton blank during passage of the carton blank through said erecting and folding station, fixed anvil means in said sealing station, a pair of end stops in said sealing station, one of which is fastened to one of said longitudinal track members and the other of which is fastened to said fixed anvil, and transversely movable platen means in said sealing station movable within said erected carton blank to seal the bottom end flaps to the bottom side flap of the erected carton blank against said fixed anvil.

* * * * *